United States Patent [19]

Hauler et al.

[11] 4,335,700

[45] Jun. 22, 1982

[54] PULSE GENERATOR, PARTICULARLY TO PROVIDE IGNITION PULSES FOR INTERNAL COMBUSTION ENGINES

[75] Inventors: Peter Hauler, Karlsruhe; Walter Hinke, Ludwigsburg, both of Fed. Rep. of Germany

[73] Assignee: Robert Bosch GmbH, Stuttgart, Fed. Rep. of Germany

[21] Appl. No.: 234,918

[22] Filed: Feb. 17, 1981

[30] Foreign Application Priority Data

Feb. 22, 1980 [DE] Fed. Rep. of Germany ..... 3006585

[51] Int. Cl.[3] ..... F02P 7/06

[52] U.S. Cl. ..... 123/617; 123/414; 310/70 R

[58] Field of Search ..... 123/414, 617; 310/70 R, 310/70 A

[56] References Cited

U.S. PATENT DOCUMENTS 4,223,249 9/1980 Eshelman ..... 123/617 X 4,237,844 12/1980 Lathlaen ..... 123/617

FOREIGN PATENT DOCUMENTS 53-71734 6/1978 Japan ..... 123/617

OTHER PUBLICATIONS

"Wiegand Effect Getting Practical", by G. M. Walker, from Electronics, Apr. 28, 1977.

*Primary Examiner*—Tony M. Argenbright

*Attorney, Agent, or Firm*—Frishauf, Holtz, Goodman & Woodward

[57] ABSTRACT

To simplify a Wiegand wire type pulse source, a Wiegand wire (4) has a coil (3) wound thereon. A permanent magnet (5) is positioned with a gap from the coil, and a magnetically permeable masking element, for example a sector-shaped disk, is movable between the magnet and the coil. The coil (3) is connected to a source of direct current (B) which so magnetizes the Wiegand wire (4) that, when a gap of the masking element occurs between the magnet (5) and the coil (3), the Wiegand wire is reversely magnetized until, again, a solid portion of the masking element is interposed in the gap between magnet (5) and coil (3) to restore the magnetic direction due to the battery (B). Re-magnetization pulses are picked off the coil (3) by a suitable pulse coupling element such as a capacitor (C).

5 Claims, 3 Drawing Figures

PULSE GENERATOR, PARTICULARLY TO PROVIDE IGNITION PULSES FOR INTERNAL COMBUSTION ENGINES

The present invention relates to a pulse generator, and more particularly to a pulse generator which is particularly adapted for use with internal combustion engines to provide ignition trigger pulses therefor.

BACKGROUND

Various types of pulse generators are known, and one particularly suitable construction utilizes a Wiegand wire. Wiegand wires, now well known, have the characteristic that, upon being subjected to a variable magnetic field, the transition of magnetization is abrupt and independent of the rate of change of a magnetic field to which the wire is exposed. Thus, the amplitude of the output pulse will not vary with rate of change of flux.

A contactless pulse source utilizing a Wiegand wire to trigger ignition pulses has been described in "Electronics", 1977, page 85. In the structure there disclosed, a Wiegand wire is embedded in, or forms the core of, a pick-up coil. Two permanent magnets are located in the magnetic field of the coil, and spaced therefrom. The permanent magnets are of opposite polarity. A rotating magnetic shield forming a diaphragm or mask rotates between the magnets and the coil, such that the magnetic field through the Wiegand wire changes its direction each time an opening in the mass or diaphragm passes the pick-up coil. This pulse source requires two permanent magnets and associated mounting structure to position the two permanent magnets relative to the coil.

THE INVENTION

It is an object to provide a pulse source which is simpler and requires only one permanent magnet, and hence less structure for mounting of the pulse source.

Briefly, a pick-up coil is provided in which a Wiegand wire is embedded. The pick-up coil is located in fixed direction with respect to a fixed permanent magnet which is positioned in magnetic flux linkage arrangement with the Wiegand wire. A sector-shaped mask or diaphragm is located on a shaft such that the mask or diaphragm passes between the coil and the magnet to periodically interrupt flux from the magnet to the Wiegand wire.

In accordance with the present invention, the coil is connected to a source of direct current to generate magnetic flux to bias the Wiegand wire, and magnetize the Wiegand wire in a specific direction. The permanent magnet is so positioned that its field opposes that generated by the direct current. The field from the permanent magnet is made to be stronger than that of the field caused by the direct current. Upon passage of a gap in the magnetic shielding mask or diaphragm, the Wiegand wire thus will receive a pulse causing reverse magnetization with respect to that caused by the electrical current, which pulse can be sensed in the very same coil element which biasses the Wiegand wire, for example by picking up the pulse by a capacitor coupled to the coil.

The pulse source has the advantage that only a single permanent magnet is needed, which substantially simplifies the structure of the rotating sector-shaped diaphragm or shielding element. A simple sheet metal punched element can be used, of small size and low weight which can be inexpensively manufactured to sizes readily compatible with the usual type of ignition breaker and distributor combination used in connection with internal combustion engines, for example of the automotive type.

The simplicity of the structure permits positioning of the pick-up coil with respect to the shaft which carries the sector-shaped magnetic mask or blocking element such that it is either axially or radially positioned with respect to the rotor. Both arrangements have respective advantages and disadvantages. Axial positioning of the pick-up coil with respect to the rotor requires a sector-shaped masking or blocking element which is somewhat more complex and therefore somewhat more expensive to make; it permits, however, longitudinal play of the shaft, and thus economy in manufacture of the overall structure because tolerances in bearings need not be extremely accurate. Further, the shielding between the magnet and the pick-up coil is particularly good, resulting in excellent noise and interference rejection, so that the output pulse picked off the pick-up coil will be easily recognized above any noise level; radial positioning between the magnet and the coil with respect to the rotor substantially simplifies the structure of the blocking diaphragm or mask; this is an advantage in overall structural simplification and of particular advantage if costs of the pulse source are the primary consideration and shielding is not as important.

Figure 1:
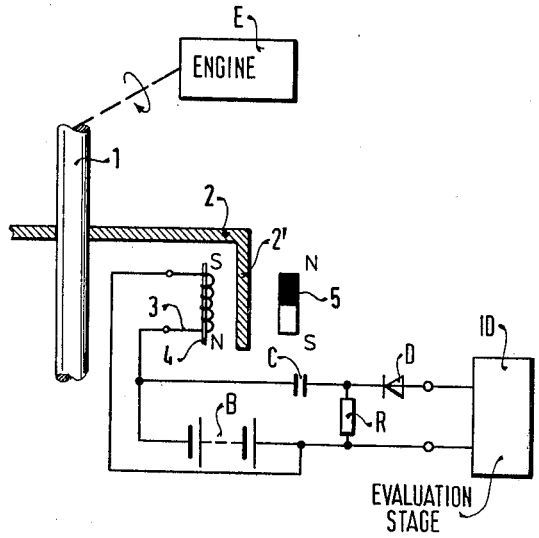
FIG. 1 is a highly schematic side view of a pulse source.

An internal combustion engine E, typically of the automotive type, has its crankshaft coupled to a shaft 1 which, for example, is the shaft of the distributor-ignition pulse generator. Shaft 1 carries an interrupter segment wheel 2. The interrupter segment wheel 2 is formed with depending segmental portions 2' which extend, with interruptions, between a permanent magnet 5 and a coil 3 wound about a Wiegand wire 4. The Wiegand wire 4 is a ferromagnetic wire which has a hard-magnetic surface over a soft-magnetic core. Upon subjection of this Wiegand wire to a rapidly changing magnetic field, a pulse is induced in the pick-up coil 3. Coil 3 and wire 4 are located parallel to the shaft 1, that is, axially with respect thereto. The permanent magnet 5 is spaced from the coil 3 about wire 4. The angled-over portion 2' of the sector wheel 2 passes between the magnet 5 and the coil 3.

Figure 2:
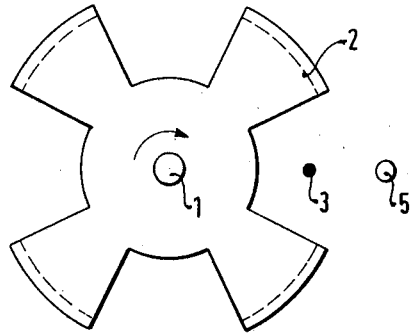
FIG. 2 is a top view of the rotating flux shielding or blocking element.

The sector wheel 2 is best seen in FIG. 2, which is a top view thereof, also illustrating the position of the coil 3 and the magnet 5. The support elements for the coil and the magnet are not shown and may be of any suitable construction. The coil 3 covers the Wiegand wires 4. The sector-shaped wheel 2, or at least the depending portions 2', passes in the gap between the coil 3 and the magnet 5. In the illustration, four positive and four negative pulses will be obtained. By suitable selection of the shape of the wheel 2 and the number of gaps and solid portions, it is of course possible to select the number of pulses for each revolution of shaft 1. When used as an ignition pulse source for an automotive-type internal combustion engine, the number of portions 2', that is, of the star-shaped sector elements, is preferably equal to the number of the cylinders.

Figure 3:
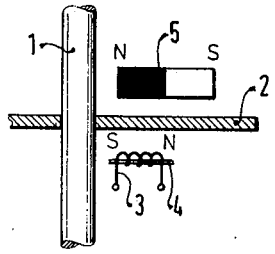
FIG. 3 is a highly schematic view of a pulse source showing radial positioning with respect to the shaft.

Direct current is applied from a battery B to the coil 3, thus pre-magnetizing the Wiegand wire 4 in a predetermined magnetic direction, indicated by S and N in FIGS. 1 and 3. The direction of current flow and the winding direction of the coil are so selected that the polarization of the wire 4, due to the current flow from the battery B, is opposite that which the wire experiences when exposed to the magnetic field from magnet 5. Contrary to the prior art, in which a separate permanet magnet was provided to pre-magnetize the Wiegand wire, current flow from the battery B is used to effect the so directed pre-magnetization. The field strength of the magnetic field from the magnet 5, when the star wheel 2 is in the position shown in FIG. 2, is substantially higher than the magnetic field derived due to current flow from the battery B through the coil 3. The magnetic field strength of the coil can readily be set or determined by including a resistor, for example an adjustable resistor (not shown) in the battery-coil circuit, or by suitably winding the coil 3.

Operation, with reference to FIGS. 1 and 2: When the magnetic flux is in the direction as shown in FIG. 1, in which the depending portion 2' is between the magnet 5 and the coil 3, flux from the magnet 5 is short-circuited by the portion 2', and flux from the magnet 5 does not reach the coil 3. The entire wheel 2 is preferably made of highly permeable material, thus providing for effective and efficient shielding. Consequently, the Wiegand wire 4 is magnetized in the direction shown by the letters S, N due to the current flow from battery B. When the gap between the star projections of wheel 2 reaches the space between coil 3 and magnet 5—see FIG. 2—the Wiegand wire 4 is reversely magnetized due to the strong flux from the magnet 5. The rapid re-magnetization of the Weigand wire 4 induces a voltage pulse in the coil 3, which can be picked off by a capacitor C, and applied through a diode D to an evaluation stage 10. A high-resistance resistor R is provided to permit discharge of the capacitor C.

Upon further rotation of the wheel 2, the Wiegand wire 4 is again re-magnetized due to the continued current flow from the battery B. This again induces a voltage pulse in the coil 3 which charges the capacitor C in opposite direction. This pulse, if it is desired to be used for control purposes, can be picked off, for example, by a reversely polarized diode, connected to another input terminal of the evaluation stage. The amplitude of the pulse, as transmitted by the capacitor C, is determined solely by the re-magnetization of the Wiegand wire 4 and thus is independent of the speed of the star wheel 2 which moves between coil 3 and magnet 5.

FIG. 1 shows axial positioning of the coil-magnet combination with respect to the shaft 1. The elements may, however, also be positioned such that they extend radially with respect to the shaft 1. FIG. 3 illustrates the radial positioning in which magnet 5 and coil 3 with the Wiegand wire 4 therein are located at right angles to the shaft 1. The star wheel 2 then can be a flat element which sector-shaped punch-outs, that is, merely have the plan aspect of FIG. 2. The polarity of current flow through the coil 3 is indicated in FIG. 3, from which the battery B and the coupling circuit as well as the evaluation stage have been omitted to simplify the drawings. It may be the same as that shown in FIG. 1.

Various changes and modifications may be made within the scope of the inventive concept, and features described in connection with one embodiment may be used with the other.

We claim:

1. Pulse generator to provide electrical pulses in dependence on the position of a movable element, particularly to provide internal combustion engine ignition pulses, in which the movable element is a shaft (1) coupled to the engine, having a pick-up coil (3);

A Wiegand wire (4) embedded in, and in magnetically flux-coupled relation to the pick-up coil;

a permanent magnet (5) positioned in flux linking relationship to said coil (3) with the Wiegand wire (4) therein;

and a magnetically permeable masking element (2, 2') formed with gaps therebetween coupled to the movable element and interposed between the coil (3) and said permanent magnet (5) to short-circuit flux from the permanent magnet to the coil when a solid portion thereof is between the magnet and the coil, and to permit flux to pass from the magnet to the coil when a gap occurs between the magnet and the coil, wherein, in accordance with the invention, the coil (3) has a direct current applied thereto which is of such direction as to cause a magnetic field in the coil which has a polarity opposite to that of the magnet (5);

and pulse pick-up means (C, D) are provided to furnish output pulses from the coil upon change of direction of magnetization of the Wiegand wire.

2. Pulse generator according to claim 1, wherein the movable element comprises a shaft (1) and the magnetically permeable masking element comprises a star wheel (2, 2') having sector-shaped solid portions with gaps therebetween.

3. Pulse generator according to claim 1, wherein the magnet (5), the coil (3) and the Wiegand wire (4) are positioned in parallel to the axis of the shaft.

4. Pulse generator according to claim 2, wherein the magnet (5), the coil (3) and the Wiegand wire (4) are positioned in parallel to the axis of the shaft; and wherein the solid portion of the sector-shaped element comprises an axially extending portion (2') passing in a gap between the coil (3) and the magnet (5).

5. Pulse generator according to claim 2, wherein the magnet and the coil (3) are positioned at right angles or radially with respect to the shaft (1).

* * * * *